US007043941B2

(12) United States Patent
Willmer et al.

(10) Patent No.: US 7,043,941 B2
(45) Date of Patent: May 16, 2006

(54) CIRCULAR KNITTING MACHINE WITH A DUST REMOVAL DEVICE

(75) Inventors: Rolf Willmer, Albstadt (DE); Roland Sickinger, Grosselfingen (DE); Klaus Berwald, Orangeburg, SC (US)

(73) Assignee: Sipra Patententwicklungs- und Beteiligungsgesellschaft mbH, Albstadt (DE)

( * ) Notice: Subject to any disclaimer, the term of this patent is extended or adjusted under 35 U.S.C. 154(b) by 0 days.

(21) Appl. No.: 11/243,441

(22) Filed: Oct. 4, 2005

(65) Prior Publication Data

US 2006/0070408 A1 Apr. 6, 2006

(30) Foreign Application Priority Data

Oct. 6, 2004 (DE) ..... 10 2004 049 001

(51) Int. Cl.
*D04B 35/32* (2006.01)

(52) U.S. Cl. ..... 66/168

(58) Field of Classification Search ..... 86/1 R, 86/8, 168
See application file for complete search history.

(56) References Cited

U.S. PATENT DOCUMENTS

| | | | | |
|---|---|---|---|---|
| 3,274,803 | A | 9/1966 | Schmidt | |
| 3,545,233 | A | 12/1970 | Lombardi | |
| 4,584,851 | A | 4/1986 | Plath | |
| 4,624,928 | A | 11/1986 | Qureshi | |
| 4,741,181 | A | 5/1988 | Plath | |
| 5,129,240 | A * | 7/1992 | Schindler | 66/8 |
| 5,408,850 | A * | 4/1995 | Kawase et al. | 66/168 |
| 5,737,942 | A * | 4/1998 | Gutschmit | 66/168 |
| 6,199,408 | B1 * | 3/2001 | Shibata | 66/168 |

FOREIGN PATENT DOCUMENTS

| | | |
|---|---|---|
| DE | 1 585 177 | 10/1970 |
| DE | 1 635 796 | 5/1971 |
| DE | 1 635 836 | 5/1971 |
| DE | 33 11 361 A1 | 10/1984 |
| DE | 35 32 856 C1 | 12/1986 |
| DE | 39 28 986 A1 | 3/1991 |
| DE | 3582856 | 6/1991 |
| EP | 0 816 546 B1 | 6/2004 |

* cited by examiner

*Primary Examiner*—Danny Worrell
(74) *Attorney, Agent, or Firm*—Michael J. Striker

(57) ABSTRACT

A circular knitting machine with a carrier (1) for knitting tools (2) and a cam housing (8) is described, the cam housing (8) being sub-divided into a plurality of segments (8*a*, 8*b*, 8*c*) which are adjacent in the circumferential direction and bear needle cams (9). According to the invention, the circular knitting machine has a dust removal device which contains air distribution channels (23) which are configured in the segments and are connected to a compressed air source via radial air supply channels (24). The air distribution channels (23) discharge into radial gaps (22) which are present between the segments and are sealed outwardly with sealing means (30) (FIG. 5).

6 Claims, 5 Drawing Sheets

CIRCULAR KNITTING MACHINE WITH A DUST REMOVAL DEVICE

FIELD OF THE INVENTION

The invention relates to a circular knitting machine comprising a frame, in which a carrier is mounted rotatably, which has a multiplicity of grooves on its circumference intended for receiving knitting tools, a plurality of segments which are situated opposite the grooves and are disposed next to each other in the circumferential direction of the carrier, are separated by radial gaps and are provided with needle cams intended for controlling the knitting tools, an annular space which is provided in an upper region of the carrier and open at the top, and a dust removal device which has means for introducing a compressed air flow into the annular space and contains at least one opening penetrating a selected segment and being in communication with a connection, which is configured on an outer side of the selected segment and serves to feed the compressed air.

BACKGROUND OF THE INVENTION

Circular knitting machines have in general the disadvantage that, during operation, fibres, dust and other contaminants are deposited above all on the knitting tools, in the grooves receiving these and on the needle cams. When using specific yarns, e.g. those made of cotton, this fiber deposition occurs even more. The resulting tendency to contamination in high-performance machines, the needle cylinders of which are rotated at rotational speeds of 60 rpm and more, is particularly critical. The degree of contamination here is already so great after a running time of a few hours that cleaning operations are imperative.

In the case of circular knitting machines of the initially described type which operate according to relative technology and in which knitting needles and knocking-over/holding-down sinkers are moved in opposite directions during loop formation, dedusting devices are hence already known (DE 35 32 856 C1) which have at least one opening penetrating a cam segment, through which opening a compressed air flow is directed. This opening is directed essentially radially and diagonally from the bottom and outwardly to the top and inwardly in such a manner that it opens into an annular space which is disposed above the pivot points of the sinkers and between the rear sides of the sinkers and the needle cylinder. By such means it is intended to avoid that fibres and dust are deposited in the sinker grooves and are compacted there. According to knowledge obtained in practice with such machines, these measures are however not adequate for effective dust removal. It is to note in this respect that the expressions "dust removal" and "dedusting" are intended to mean within the scope of the present invention both the subsequent removal of already deposited fibres and dust particles and the keeping clean, i.e. preventing deposition of these particles.

In addition, circular knitting machines with dedusting devices are known, in which the entire cam housing is surrounded by an essentially closed housing. Compressed air is introduced from outside into this housing. In the case of a circular rib knitting machine, the compressed air from the housing is directed for example into an annular gap between the needle cylinder and a dial assigned thereto (DE-PS 15 85 177). In contrast, the compressed air from the housing passes in the case of single machines e.g. into an annular gap which is configured between an upper region of the needle cylinder and a sinker ring which is mounted on the latter by means of radial webs (e.g. EP 0 816 546 B1). Even these two types of dedusting, as tests have shown, are inadequate in the case of high-performance machines. In addition, they have the additional disadvantage that the closed housing makes access to the circular knitting machine difficult, and the housing must be opened or removed before operations can be performed on different functional parts, e.g. on the needle cams for the purpose of changing the loop size.

In addition, numerous further dedusting devices which operate with compressed air are known, said devices likewise effecting however either inadequate dedusting and/or demanding complicated and hence expensive and undesired changes to the circular knitting machine (e.g. DE-OS 16 35 796 and DE-OS 16 35 836).

SUMMARY OF THE INVENTION

Starting from the above it is an object of the present invention to provide a circular knitting machine with an effective dust removal device.

A further object of the present invention is to provide the circular knitting machine specified above with a dust removal device which provides good dust removal properties.

Yet another object of the present invention is to design the dust removal device such that good dedusting properties are achieved even in combination with a circular knitting machine operating with high-performance.

In accordance with the invention, these and other objects are solved by means of a circular knitting machine of the kind specified above and which is characterized in that the opening is configured as an air distribution channel extending in the circumferential direction of the carrier, said air distribution channel discharging at outlet openings situated below the annular space into the two radial gaps situated between the selected segment and two adjacent segments and being connected to the connection by a radially extending air supply channel, and in that the dust removal device contains sealing means which seal the two annular gaps radially out with the outlet openings.

Further advantegeous features of the invention are revealed in the subclaims.

BRIEF DESCRIPTION OF THE DRAWINGS

The invention is explained in more detail subsequently in one embodiment in conjunction with the accompanying drawings. There are shown.

DETAILED DESCRIPTION OF A PREFERRED EMBODIMENT OF THE INVENTION

Figure 1:
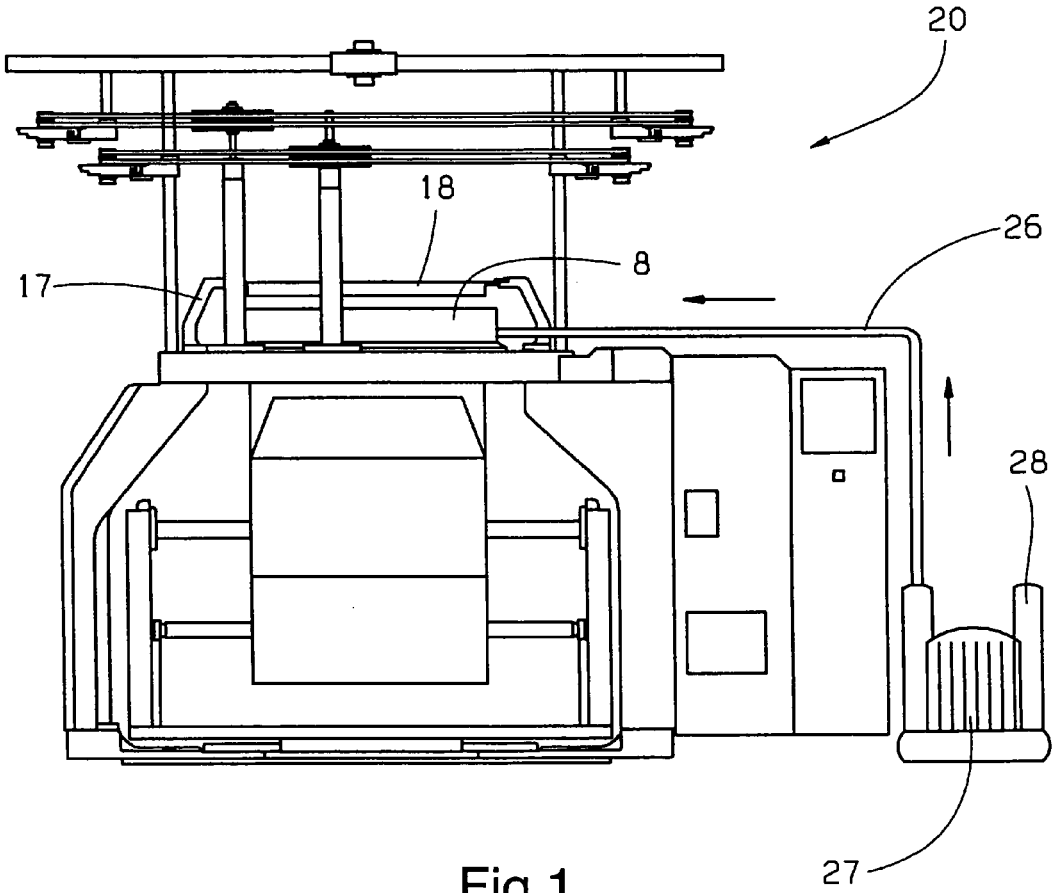
FIG. 1 roughly schematically, an overall view of a circular knitting machine according to the invention.
Figure 2:
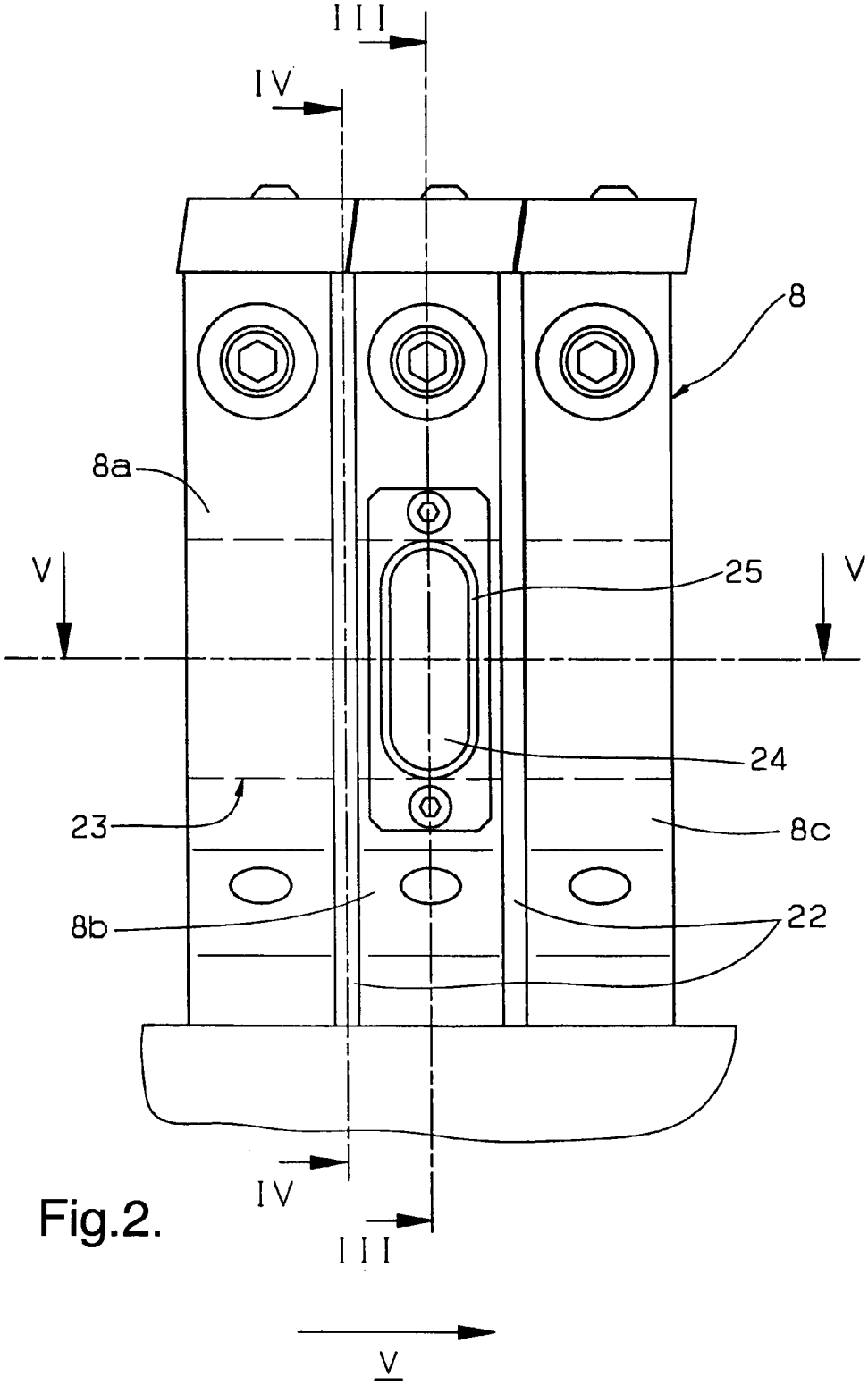
FIG. 2 a front view from outside on a part of a cam housing of the circular knitting machine according to FIG. 1.
Figure 3:
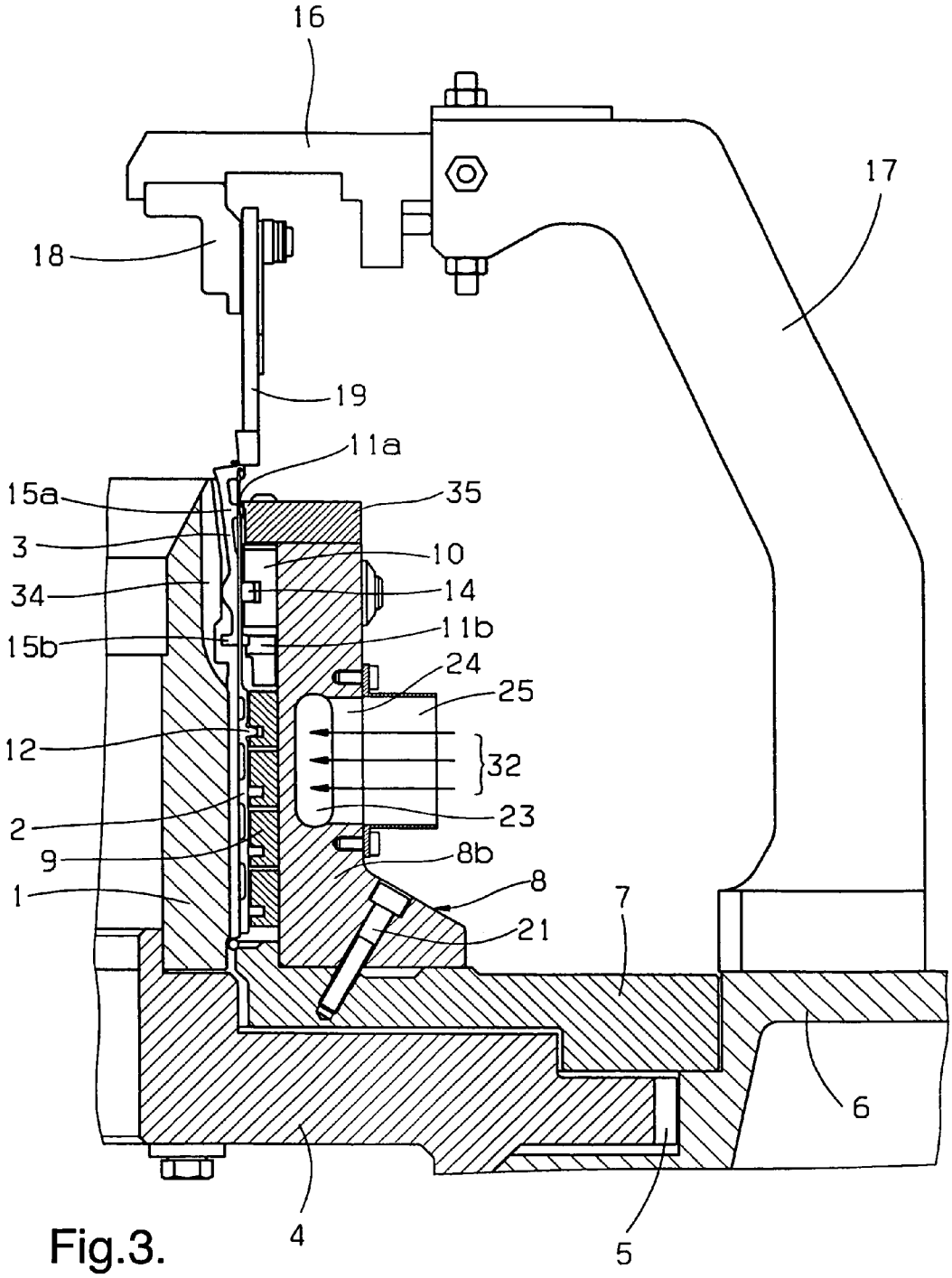
FIG. 3 schematically, a vertical radial section through the circular knitting machine according to the invention along the line III—III of FIG. 2 and in the region of a compressed air connection which is fitted on one segment of the cam housing.

The basic structure of a circular knitting machine according to the invention is illustrated in FIGS. 1 to 3 by an embodiment which is considered at present to be the best and in conjunction with a circular knitting machine operating according to relative technology. The circular knitting machine contains a normal carrier 1 which has axis-parallel guides in a lower region in order to form grooves in which first knitting tools, e.g. normal latch needles 2, are mounted displaceably parallel to the axis of rotation of the carrier 1. In an upper region, the carrier 1 is provided with axis-parallel guides in order to form further grooves in which second knitting tools, e.g. normal knocking-over/holding-down sinkers 3 are mounted. The sinkers 3 are mounted displaceably parallel to the axis of the carrier 1 and, in addition, can perform the normal knocking-over movements transversely thereto. The sinkers 3 are disposed with the same gauge as the needles 2 in the carrier 1, but are at a gap from the needles 2 and staggered so that every sinker 3 comes to be situated between two respective needles 2. The carrier 1, as illustrated in FIG. 3, can be a needle cylinder which, in a lower region, has the grooves for the latch needles 2 and, in an upper region, grooves for the sinkers 3. Alternatively, the carrier 1 in the lower region can be configured as a normal needle cylinder and, in the upper region, as a separate sinker ring which is connected rigidly to the needle cylinder.

The carrier 1 is supported on a carrier ring 4 (FIG. 3) in a machine frame shown only in FIG. 1 and is disposed with its axis coaxially to a vertical machine axis here, not shown. The carrier ring 4 is mounted rotatably about the machine axis together with the carrier 1 and is provided for this purpose with an outer toothed ring 5 which is in engagement with a driving pinion, not shown, which can be set to rotate by a drive motor of the circular knitting machine.

A base plate 7, on which a stationery cam housing or cam box ring 8 surrounding the carrier 1 is mounted, is mounted in a stationery carrier ring 6. Needle cams 9, 10 and 11*a*, 11*b* which are orientated towards the carrier 1 are mounted on this cam housing 8 and cooperate with radially outwardly projecting butts 12 of the needles 2 or butts 14 and 15*a*, 15*b* of the sinkers 3. The arrangement is encountered corresponding to the so-called relative (movement) technology such that the needles 2 and sinkers 3, for the purpose of loop formation, can perform movements which are effected parallel to the machine axis but directed in the opposite direction by means of the butts 12, 14 and needle cams 9, 10. In addition, the sinkers 3 can be pivoted radially relative to the carrier 1 by means of the butts 15*a*, 15*b* and needle cams 11*a*, 11*b*.

Furthermore, the circular knitting machine has a plurality of mountings 16 which are supported by means of supports 17 on the carrier ring 6 and bear a thread guide ring 18 from which thread guides 19 (FIG. 3) hang down, by means of which threads, not shown, can be supplied to needles 2 which are raised in a manner known per se. Above the thread guide ring 18, normal thread supply devices (thread regulating wheels), thread tension devices and the like are provided, as is indicated schematically in FIG. 1 by the reference number 20.

As FIG. 2 shows in particular, the cam ring 8 has a plurality of segments 8*a*, 8*b*, 8*c* disposed next to each other in the circumferential direction, which segments are mounted on the base plate 7 by means of screws 21 (FIG. 3). These segments, which can be assigned respectively to one or more knitting systems, stand radially out with the carrier 1 opposite the grooves for the needles 2 and sinkers 3 and are separated by narrow radial gaps 22 in a circumferential direction of the carrier 1 indicated in FIG. 2 by an arrow v. On the inner sides orientated towards and facing the grooves of the carrier 1, the segments 8*a* to 8*c* are provided with the needle cams 9 to 11*b*.

Circular knitting machines of this type and their mode of operation are known in general (e.g. DE 33 11 361 C2, DE 35 32 856 C1, DE 39 28 986 C2) and do not require therefore to be explained in more detail.

According to the invention, the described circular knitting machine has a dust removal device. This device contains, according to FIGS. 2 to 5, at least one air distribution channel 23 in the form of an opening which is configured in a selected segment, e.g. segment 8*b*, and penetrates the latter completely in the circumferential direction of the carrier 1 (arrow v in FIG. 5). The air distribution channel 23 is connected to a connection for compressed air on an outer side of this segment 8*b* via an essentially radially extending air supply channel 24 configured likewise in the segment 8*b*, said connection 25 comprising e.g. a connection piece for the one end of a compressed air hose 26 shown only in FIG. 1. The other end of the compressed air hose 26 is connected to the compressed air outlet of a compressed air source 28, e.g. a fan or compressor, which is actuated for example by an electric motor 27 and placed next to the circular knitting machine, as a result of which compressed air is blown in the direction of the arrows visible in FIG. 1 into the air supply channel 24 during operation of the circular knitting machine.

Figure 4:
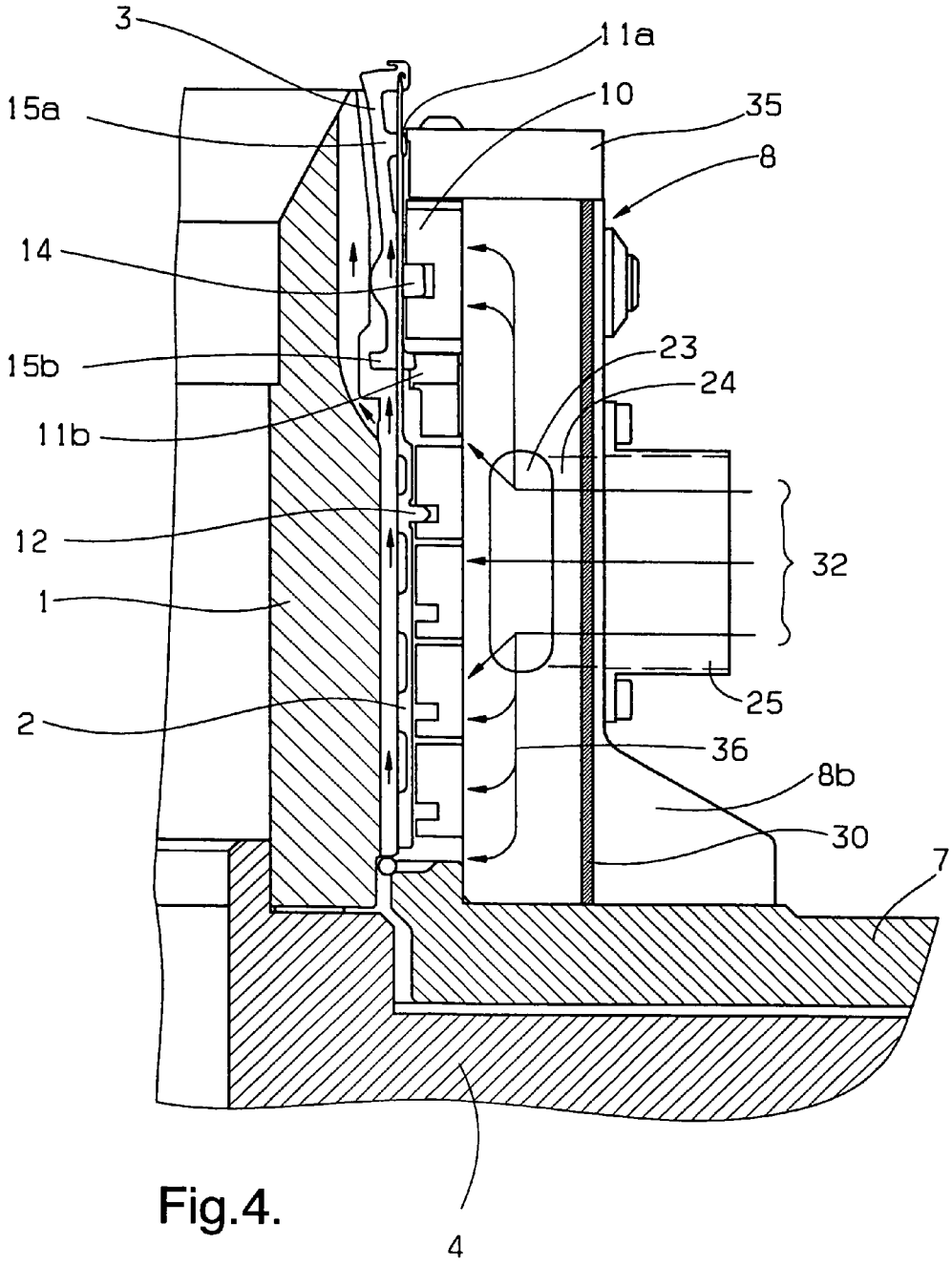
FIG. 4 a schematic radial section analogous to FIG. 3, however along a line IV—IV of FIG. 2 and in the region of a radial gap between two segments of the cam housing.
Figure 5:
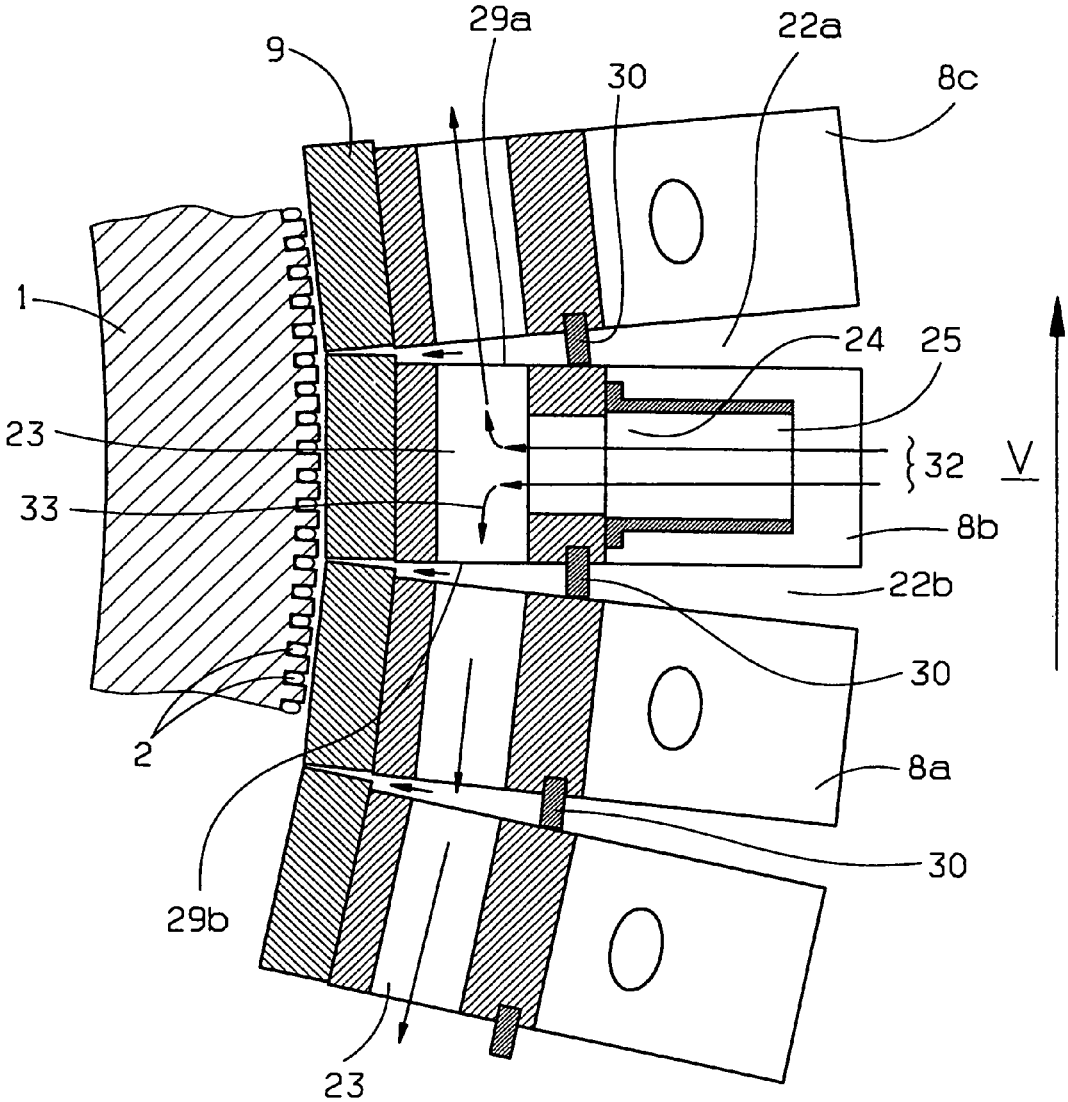
FIG. 5 a horizontal section through the circular knitting machine along the line V—V of FIG. 2.

The air distribution channel 23 discharges, according to FIG. 5, at the two lateral ends of the segment 8*b*, in particular at two outlet openings 29*a* and 29*b* situated there, into radial gaps 22*a* or 22*b* which are configured between the selected segment 8*b* and adjacent segments, here segments 8*a* and 8*c*, and have the normal wedge shape in plan view. These radial gaps 22*a*, 22*b* are sealed preferably in an airtight manner on the radially outwardly situated sides of the outlet openings 29*a*, 29*b* by means of sealing means 30 of the dedusting device according to the invention. The sealing means 30 comprise for example flexible plates and extend expediently, as FIG. 4 shows, over the entire height of the segment 8*b*. Rubber or a rubber-like material is used expediently for the sealing means 30.

The previously described dedusting device operates under the assumption that only the segment 8*b* is provided with an air distribution channel 23, whilst the remaining segments 8*a*, 8*c* etc. are produced essentially from solid material, essentially as follows.

Compressed air produced by the compressed air source 28 is supplied to the air supply channel 24 in the direction of arrows 32 (FIGS. 3 and 4) and passes from there into the air distribution channel 23 where it is deflected in the circumferential direction according to arrows 33 (FIG. 5) and passes through the outlet openings 29*a*, 29*b* into the radial gaps 22*a*, 22*b* which the segment 8*b* forms with the two adjacent segments 8*a*, 8*c*. Since the outlet openings 29*a*, 29*b* are sealed externally by the sealing means 30, the air can only flow radially inwardly where it discharges from the radial gaps 22*a*, 22*b* and enters into a narrow intermediate space which is present between the grooves of the carrier 1 and the selected segment 8*b*. From there, the air then flows upwards parallel to the axis of the carrier 1 where it passes into an annular space 34 which is provided in an upper region of the carrier 1 and is axially open at the top. In particular, this space 34 is disposed for instance at that height which corresponds to the pivot region of the sinkers 3 (FIG. 3). The space 34 is delimited radially outwardly by the segment 8*b* and upwardly expediently by a cam ring 35 supported on the segments 8*a*, 8*b*, 8*c* etc., on the radial inside of which ring the needle cams 11*a* are mounted.

The outlet openings 29*a*, 29*b*, as FIGS. 3 and 4 show, are disposed at least partially below the space 34, said openings extending particularly advantageously up to a comparatively low region situated below the space 34. It is consequently achieved that the compressed air enters at comparatively deeply situated points into the intermediate spaces between the carrier 1 and the segments 8*a*, 8*b*, 8*c* etc. and is guided from there to the space 34 in the manner of a forced guide.

Tests have revealed that the air guide according to the invention leads to a considerable reduction in contaminants, in particular even in the region of the needle cams 9 and of the grooves for the needles 2 situated opposite the cams 9. By means of the suction effect produced in the manner of a chimney and the rotation of the carrier 1 relative to the selected segment 8*b* effected during operation, dust and fibres are effectively removed from the grooves or prevented from entering into the grooves. Even in the space 34 and in the loop formation region situated above said space, contamination is substantially less than previously.

In a particularly preferred embodiment of the invention, a plurality or, at best as indicated in FIG. 5, all the segments 8*a*, 8*b*, 8*c* etc. which are present are provided with respectively one air distribution channel 23. In this case, all the radial gaps 22, into which at least one of the air distribution channels 23 discharges with an outlet opening 29*a* or 29*b*, are sealed outwardly with a corresponding sealing means 30. The air distribution channels 23 of the various segments 8*a*, 8*b*, 8*c* etc. then form a flow channel which is more or less continuous in the cam housing 8 and circulates in the circumferential direction (arrow v), said flow channel being interrupted only by the radial gaps 22 through which the supplied compressed air can escape radially inwardly. As a result, it can be achieved that the entire intermediate space situated between the carrier 1 and the cam housing 8 is rinsed constantly with compressed air during operation and is cleaned or kept clean. The cleaning effect which can be achieved during rotation of the carrier 1 is consequently multiplied. It is thereby possible to provide only one segment (e.g. 8*b* in FIG. 5) or several selected segments which are disposed if necessary distributed in the circumferential direction with respectively one air supply channel 24 and one connection 25 and to connect all connections 25 which are present to one or more compressed air sources 28.

The dedusting device configured according to the invention offers furthermore the possibility in a simple manner of directing the supplied compressed air at least partially in a pre-selected direction. This can be effected for example in that the outlet openings 29*a*, 29*b* are given cross-sections other than the oblong-like ones illustrated. Furthermore, it would be possible to dispose the axes of the air distribution channels 23 diagonally relative to an imaginary circular line which is formed like a polygon in the circumferential direction through the central axes of all the segments 8*a*, 8*b*, 8*c* etc. A further variant would be to dispose the outlet openings 29*a*, 29*b* offset relative to each other in the radial and/or in the axial direction of the carrier 1 in order to achieve that the air flow emanating from an outlet opening 29*a*, 29*b* does not enter directly into an oppositely situated outlet opening of an adjacent segment but strikes the end face of this segment and is deflected from the latter at least partially in the direction of the carrier 1.

In addition, the invention presents the advantage that a good cooling effect for the carrier 1 and the cam housing 8 is also achieved by the supplied compressed air. In particular, if all the segments 8*a*, 8*b*, 8*c* etc. are provided with corresponding air distribution channels 23, such a good cooling effect is achieved that additional measures for cooling are not required, even if the carrier 1 is set to rotate at 60 rpm or more during operation.

The invention is not restricted to the described embodiment which can be modified in many ways. It is thereby clear that the invention can be applied both to circular knitting machines with a carrier diameter of 30" and more and to circular knitting machines with carrier diameters of 26" and less. Furthermore, the cross-sectional shapes of the air distribution channels 23 per se can be of any arbitrary shape, however those shapes are preferred for cost reasons which can be produced simply, such as e.g. circular borings, and consequently make complex machining of the segments 8*a*, 8*b*, 8*c* etc. unnecessary. Furthermore, the position of the air distribution channels 23 within the segments 8*a*, 8*b*, 8*c* etc. should be chosen in an extensively arbitrary manner and in the individual case such that sufficiently good dedusting is obtained. For this purpose, air guides seem at present to be best suited which correspond for instance to the air distribution indicated in FIG. 4 by arrows 36 since, in this case, the intermediate space between the carrier 1 and the cam housing 8 is rinsed with compressed air over its entire height measured in the axial direction. It is assumed in this respect, which normally is possible, that the intermediate space is comparatively strongly sealed by the base plate 7 and the carrier ring 4, as FIGS. 3 and 4 show, such that the compressed air will predominantly escape in the direction of space 34. Finally it goes without saying that the different features can also be applied in combinations other than those described and illustrated.

It will be understood, that each of the elements described above or two or more together, may also find a useful application in other types of construction differing from the types described above.

While the invention has been illustrated and described as embodied in a circular knitting machine and a dust removal device therefor, it is not intended to be limited to the details shown, since various modifications and structural changes may be made without departing in any way from the spirit of the present invention.

Without further analysis, the forgoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. Circular knitting machine, comprising: a frame, a carrier (1) rotatably mounted in said frame and having a multiplicity of grooves being distributed in an circumferential direction and intended for receiving knitting tools (2, 3), a plurality of segments (8*a*, 8*b*, 8*c*) being situated opposite said grooves, disposed next to each other in the circumferential direction of said carrier (1), separated by radial gaps (22*a*, 22*b*) and provided with needle cams (9, 10, 11*a*, 11*b*) intended for controlling the knitting tools (2, 3), an annular space (34) being provided in an upper region of said carrier (1) and open at the top, and a dust removal device having means for introducing a flow of compressed air into said annular space (34), said means containing at least one opening penetrating a selected one of said segments (8*b*) and being in communication with a connection (25) for said compressed air, said connection being configured on an outer side of said selected segment (8*b*), wherein said opening is configured as an air distribution channel (23) extending in said circumferential direction of said carrier (1), said air distribution channel discharging at outlet openings (29*a*, 29*b*) situated below said annular space (34) into two radial gaps (22*a*, 22*b*) situated between said selected segment (8*b*) and two adjacent segments (8*a*, 8*c*) and being connected to said connection (25) by a radially extending air supply channel (24), and wherein said dust removal device contains sealing means (30) sealing said two annular gaps (22*a*, 22*b*) radially out with said outlet openings (29*a*, 29*b*).

2. Circular knitting machine according to claim 1, wherein all said segments (8*a*, 8*b*, 8*c*) are provided respectively with one air distribution channel (23) extending in said circumferential direction, each air distribution channel (23) discharging at outlet openings (29*a*, 29*b*) situated below said annular space (34) into radial gaps (e.g. 22*a*, 22*b*) respectively formed between two adjacent segments (e.g. 8*a*, 8*c*), and wherein all said radial gaps (22) are sealed by sealing means (30) at points situated radially outwith said outlet openings (29*a*, 29*b*).

3. Circular knitting machine according to claim 2, wherein said air distribution channels (23) of a plurality of segments (8*a*, 8*b*, 8*c*) are connected to a connection (25) for the compressed air by respective radial air supply channels (24).

4. Circular knitting machine according to claim 1, wherein said sealing means (30) comprise flexible elements.

5. Circular knitting machine according to claim 1, wherein said outlet openings (29*a*, 29*b*) are disposed and/or configured such that compressed air flowing into said radial gaps (22) enters at least partially in a lower region of said grooves of said carrier (1) into intermediate spaces between the carrier (1) and said segments (8*a*, 8*b*, 8*c*) and flows from there along said grooves axially in a direction of said annular space (34).

6. Circular knitting machine according to claim 5, being configured as a circular knitting machine operating according to a relative technology and having knitting needles (2) and knocking-over/holding-down sinkers (3) which are mounted in said grooves of said carrier (1) and are moveable in opposite directions in order to perform knitting operations, said sinkers (3) also being mounted radially pivotably, said annular space (34) being delimited at a top by said carrier (1) and a cam ring (35) on which needle cams (11*a*) are mounted being intended to pivot the sinkers (3).

* * * * *